US010486842B2

(12) United States Patent
Lindt et al.

(10) Patent No.: US 10,486,842 B2
(45) Date of Patent: Nov. 26, 2019

(54) METHOD AND INSTALLATION FOR PRODUCING A PACK

(71) Applicant: DS Smith Packaging Deutschland Stiftung & Co. KG, Nuremberg (DE)

(72) Inventors: Jakob Lindt, Pirmasens (DE); Werner Allmang, Altenglan (DE); Manfred Roos, Muhlbach (DE)

(73) Assignee: DS Smith Packaging Deutschland Stiftung & Co. KG, Nuremberg (DE)

( * ) Notice: Subject to any disclaimer, the term of this patent is extended or adjusted under 35 U.S.C. 154(b) by 482 days.

(21) Appl. No.: 15/033,633

(22) PCT Filed: Nov. 12, 2014

(86) PCT No.: PCT/EP2014/074398
§ 371 (c)(1),
(2) Date: Apr. 30, 2016

(87) PCT Pub. No.: WO2015/071327
PCT Pub. Date: May 21, 2015

(65) Prior Publication Data

US 2016/0280407 A1 Sep. 29, 2016

(30) Foreign Application Priority Data

Nov. 14, 2013 (DE) ..... 10 2013 112 566

(51) Int. Cl.
*B65B 43/10* (2006.01)
*B65D 5/72* (2006.01)
(Continued)

(52) U.S. Cl.
CPC ..... *B65B 43/10* (2013.01); *B65D 5/22* (2013.01); *B65D 5/4283* (2013.01); *B65D 5/52* (2013.01);
(Continued)

(58) Field of Classification Search
CPC .. B65D 5/724; B65D 5/5213; B65D 83/0817; B65D 83/0858; A47F 1/126; B31B 2100/00; B31B 2100/0024
(Continued)

(56) References Cited

U.S. PATENT DOCUMENTS 1,593,532 A 7/1926 Hansen
1,718,572 A 6/1929 Marcuse
(Continued)

FOREIGN PATENT DOCUMENTS

AT 280878 4/1970
CN 1932886 A 3/2007
(Continued)

OTHER PUBLICATIONS

International Preliminary Report on Patentability issued in International Application No. PCT/Ep2014/074398 dated May 26, 2016.
(Continued)

*Primary Examiner* — Hemant Desai
*Assistant Examiner* — Valentin Neacsu
(74) *Attorney, Agent, or Firm* — McDonnell Boehnen Hulbert & Berghoff

(57) ABSTRACT

The invention relates to a method for producing a packaging and a system for such. The method includes the following steps: providing a precut blank (1) consisting of a foldable material having a bottom (3) and hinged to it, lateral panels (4), a rear panel (6) and a front panel (5), fastening of an unstressed elastic element (15) to the front panel (5) or to connecting flaps (7) that are hinged to the front panel (5), erecting the lateral panels (4), the rear panel (6) and the front panel (5) out of a flat transport condition into an unfolded usable condition and connecting the lateral walls (4) with the rear panel (6) and the front panel (5) and tensioning the elastic element (15).

12 Claims, 3 Drawing Sheets

(51) Int. Cl.

| | |
|---|---|
| ***B65D 5/22*** | (2006.01) |
| ***B65D 5/52*** | (2006.01) |
| ***B65D 5/42*** | (2006.01) |
| *B31B 50/26* | (2017.01) |
| *B31B 50/52* | (2017.01) |
| *B31B 50/81* | (2017.01) |
| *B31B 100/00* | (2017.01) |
| *B31B 110/35* | (2017.01) |

(52) U.S. Cl.
CPC ..... *B65D 5/724* (2013.01); *B31B 50/26* (2017.08); *B31B 50/52* (2017.08); *B31B 50/81* (2017.08); *B31B 50/811* (2017.08); *B31B 2100/00* (2017.08); *B31B 2100/0024* (2017.08); *B31B 2110/35* (2017.08)

(58) Field of Classification Search
USPC ..... 206/805, 817, 559, 561, 758; 211/126.15, 72, 279; 53/564
See application file for complete search history.

(56) References Cited

U.S. PATENT DOCUMENTS

| | | | | |
|---|---|---|---|---|
| 1,959,614 | A | 5/1934 | Coons | |
| 2,185,605 | A | 1/1940 | Murphy | |
| 2,331,035 | A | 10/1943 | Lundstrom | |
| 2,634,855 | A | 4/1953 | Mandel | |
| 2,735,553 | A * | 2/1956 | Lehman | A47F 1/126 211/59.3 |
| 2,774,467 | A | 12/1956 | Michiel | |
| 2,937,742 | A * | 5/1960 | Michiel | B65D 5/48024 206/559 |
| 3,122,236 | A | 2/1964 | Michiel | |
| 3,202,316 | A | 8/1965 | Silver | |
| 3,373,922 | A | 3/1968 | Watts | |
| 3,423,143 | A | 1/1969 | Bunger | |
| 3,591,049 | A | 7/1971 | Auriemma | |
| 3,647,114 | A | 3/1972 | Bleuer | |
| 4,020,946 | A | 5/1977 | Gardner | |
| 4,588,093 | A | 5/1986 | Field | |
| 4,616,767 | A | 10/1986 | Seido | |
| 4,616,787 | A | 10/1986 | Kirsten | |
| 4,844,331 | A | 7/1989 | Oldfather | |
| 5,161,702 | A | 11/1992 | Skalski | |
| 5,197,631 | A | 3/1993 | Mishima | |
| 5,393,291 | A | 2/1995 | Wingerter | |
| 5,988,407 | A | 11/1999 | Battaglia | |
| 5,992,683 | A | 11/1999 | Sigl | |
| 6,015,051 | A | 1/2000 | Battaglia | |
| 6,109,458 | A | 8/2000 | Walsh | |
| 6,193,067 | B1 | 2/2001 | McMahan | |
| 6,227,386 | B1 | 5/2001 | Close | |
| 6,454,107 | B1 * | 9/2002 | Belanger | B65D 5/724 206/556 |
| 7,048,464 | B2 | 5/2006 | Ronnquist | |
| 7,284,662 | B2 | 10/2007 | Debusk | |
| 7,481,313 | B1 * | 1/2009 | Kramedjian | B65D 5/0281 206/427 |
| 7,497,342 | B2 | 3/2009 | Hardy | |
| 7,896,172 | B1 | 3/2011 | Hester | |
| 7,997,427 | B2 | 8/2011 | Lowenbraun | |
| 8,646,621 | B2 | 2/2014 | Zacherle | |
| 8,997,997 | B2 | 4/2015 | Close | |
| 9,889,962 | B2 * | 2/2018 | McDonald | B65D 5/724 |
| 2004/0178157 | A1 | 9/2004 | Tse | |
| 2005/0072747 | A1 | 4/2005 | Roslof | |
| 2005/0161413 | A1 | 7/2005 | Close | |
| 2007/0108083 | A1 | 5/2007 | Sonon | |
| 2009/0020548 | A1 | 1/2009 | Vandruff | |
| 2011/0294638 | A1 * | 12/2011 | Tosevski | B65D 5/22 493/123 |
| 2013/0037562 | A1 | 2/2013 | Close | |
| 2015/0166249 | A1 * | 6/2015 | McDonald | B65D 83/0858 206/758 |
| 2015/0284134 | A1 | 10/2015 | Kreutzer | |
| 2016/0280407 | A1 | 9/2016 | Lindt | |
| 2016/0280415 | A1 | 9/2016 | Mcdonald | |
| 2016/0296040 | A1 | 10/2016 | Mcdonald | |
| 2016/0297600 | A1 | 10/2016 | Mcdonald | |

FOREIGN PATENT DOCUMENTS

| | | | | |
|---|---|---|---|---|
| CN | 2882432 | Y | 3/2007 | |
| CN | 1956891 | A | 5/2007 | |
| CN | 201026050 | Y | 2/2008 | |
| CN | 101658373 | A | 3/2010 | |
| CN | 201948530 | U | 8/2011 | |
| DE | 1554649 | | 3/1970 | |
| DE | 7510538 | | 8/1975 | |
| DE | 8328422 | U1 | 1/1984 | |
| DE | 4443775 | A1 | 6/1996 | |
| DE | 29908078 | U1 | 10/1999 | |
| DE | 20316963 | U1 | 4/2005 | |
| DE | 10352206 | A1 | 6/2005 | |
| DE | 102004015701 | B3 | 7/2005 | |
| DE | 102004015576 | A1 * | 11/2005 | A47F 1/126 |
| DE | 202006007162 | U1 | 12/2006 | |
| DE | 102005056162 | A1 | 7/2007 | |
| DE | 202007011163 | U1 | 2/2008 | |
| DE | 102007034862 | A1 | 1/2009 | |
| DE | 102007042764 | A1 | 3/2009 | |
| DE | 102010053042 | A1 | 3/2012 | |
| DE | 10314232 | A1 | 10/2014 | |
| EP | 0520885 | A1 | 12/1992 | |
| EP | 1462034 | A1 | 9/2004 | |
| EP | 2917133 | B1 | 1/2018 | |
| FR | 2628357 | A1 | 9/1989 | |
| FR | 2646398 | A1 | 11/1990 | |
| FR | 2762502 | A1 | 10/1998 | |
| GB | 1432723 | | 4/1976 | |
| GB | 2407083 | A | 1/2005 | |
| GB | 2503677 | A | 1/2014 | |
| GB | 2503759 | A | 1/2014 | |
| GB | 2527438 | A | 12/2015 | |
| JP | 59-128272 | S | 8/1984 | |
| JP | 63031865 | U | 1/1988 | |
| JP | H06255685 | | 9/1994 | |
| JP | 07291372 | A | 11/1995 | |
| JP | 09224789 | | 9/1997 | |
| JP | H107129 | A | 1/1998 | |
| JP | 2001017281 | A | 1/2001 | |
| JP | 3171773 | U | 11/2011 | |
| RU | 2243933 | C2 | 10/2005 | |
| WO | 99/62382 | A1 | 12/1999 | |
| WO | 01/65981 | A1 | 9/2001 | |
| WO | 2010048680 | A1 | 5/2010 | |
| WO | 10/109411 | A1 | 9/2010 | |
| WO | 11/067488 | A1 | 6/2011 | |
| WO | 2014006398 | A2 | 1/2014 | |
| WO | 14/072701 | A1 | 5/2014 | |
| WO | 14/074397 | A1 | 5/2014 | |
| WO | 15/071326 | A1 | 5/2015 | |
| WO | 15/071327 | A1 | 5/2015 | |
| WO | 17/077289 | A1 | 5/2017 | |

OTHER PUBLICATIONS

Office Action issued in German Patent Application No. 10 2013 112 566.2 dated Mar. 22, 2017.
Singapore Search Report for SG Application No. 11201603782X, dated Nov. 2, 2016.
Office Action dated Apr. 20, 2017, for corresponding Australian application No. 2014350253.
Office Action dated Nov. 14, 2013, for corresponding Australian application No. 2014350254.
Office Action dated Nov. 26, 2018, for corresponding Australian application No. 2018205164.
Office Action dated Jun. 15, 2017, for corresponding Canadian application No. 2889476.
Office Action dated Oct. 12, 2016, for corresponding Canadian application No. 2889476.

(56) References Cited

OTHER PUBLICATIONS

Office Action dated Apr. 12, 2016, for corresponding Chinese application No. 201380056883.1.
Office Action dated Apr. 12, 2017, for corresponding Chinese application No. 201380056883.1.
Office Action dated Nov. 28, 2017, for corresponding Chinese application No. 201380056883.1.
Office Action dated Apr. 2, 2018, for corresponding Chinese application No. 201480062421.5.
Office Action dated Nov. 27, 2018, for corresponding Chinese application No. 201480062421.5.
Office Action dated Feb. 26, 2017, for corresponding Chinese application No. 201480062422.X.
Office Action dated Nov. 27, 2018, for corresponding Chinese application No. 201480062422.X.
Office Action dated Aug. 13, 2018, for corresponding European application No. 202013012351.6.
Office Action dated Aug. 13, 2018, for corresponding European application No. 2202013012359.1.
Abstract Machine Translation of DE 4443775, Jun. 13, 1996.
Description Machine Translation of DE 7510538, Jun. 11, 2018.
Abstract Machine Translation of DE 10314232, Oct. 14, 2004.
Abstract Machine Translation of DE 10352206, Jun. 16, 2005.
Machine Translation of DE 20316963, Apr. 21, 2005.
Abstract Machine Translation of DE 102004015701, Jul. 21, 2005.
Abstract Machine Translation of DE 102007034862, Jan. 29, 2009.
Machine Translation of DE 202007011163, Feb. 14, 2008.
Office Action dated May 19, 2016, for corresponding European application No. 13789382.2.
Machine Translation of FR 2762502, Oct. 30, 1998.
Office Action dated Feb. 21, 2013, for European application No. GB1219969.1.
Office Action dated Jul. 23, 2013, for European application No. GB1219969.1.
Office Action dated Aug. 16, 2016, for European application No. GB1511610.6.
Office Action dated Apr. 17, 2018, for Japanese application No. 2015-519351.
Abstract Machine Translation of JPH06255685, Sep. 13, 1994.
Abstract Machine Translation of JPH07291372, Nov. 7, 1995.
International Preliminary Report on Patentability for corresponding application No. PCT/EP2014/074397, dated May 17, 2016.
International Search Report for corresponding application No. PCT/EP2014/074397, dated Jan. 22, 2015.
Written Opinion for corresponding application No. PCT/EP2014/074397, dated Jan. 22, 2015.
International Search Report for corresponding application No. PCT/EP2014/074398, dated Jan. 22, 2015.
Written Opinion for corresponding application No. PCT/EP2014/074398, dated Jan. 22, 2015.
International Preliminary Report on Patentability for corresponding application No. PCT/GB2013/051755, dated Jan. 6, 2015.
International Search Report for corresponding application No. PCT/GB2013/051755, dated Nov. 28, 2013.
Written Opinion for corresponding application No. PCT/GB2013/051755, dated Jan. 6, 2015.
International Preliminary Report on Patentability for corresponding application No. PCT/GB2013/052900, dated May 12, 2015.
International Search Report for corresponding application No. PCT/GB2013/052900, dated Jan. 24, 2014.
Written Opinion for corresponding application No. PCT/GB2013/052900, dated Jan. 24, 2014.
International Search Report for corresponding application No. PCT/US2017/059300, dated Jan. 23, 2018.
Written Opinion for corresponding application No. PCT/US2017/059300, dated Jan. 23, 2018.
International Search Report for corresponding application No. PCT/US2018/032906, dated Jul. 31, 2018.
Written Opinion for corresponding application No. PCT/US2018/032906, dated Jul. 31, 2018.
English translation of Russian Office Action dated Feb. 6, 2017, for corresponding application No. 2015112634.
English translation of Russian Office Action dated Sep. 13, 2016, for corresponding application No. 2015112634.
Russian Search Report dated Sep. 13, 2016, for corresponding application No. 2015112634.
English translation of Russian Office Action dated Sep. 21, 2018, for corresponding application No. 2017146618.
Russian Search Report dated Sep. 21, 2018, for corresponding application No. 2017146618.
Search Report for corresponding Singapore application No. 11201803448R, dated Jan. 21, 2019.
Machine Translation of WO2011/067488, Jun. 9, 2011.
Search Report for corresponding application No. GB1211787.5, dated Jul. 10, 2013.
Office Action for corresponding application No. GB1211787.5, dated Sep. 14, 2015.
Office Action for corresponding application No. GB1211787.5, dated Oct. 16, 2015.
Search Report for corresponding application No. GB1300373.6, dated Jan. 29, 2014.
Office Action for corresponding application No. GB1300373.6, dated Sep. 15, 2014.
Search Report for corresponding application No. GB1414725.0, dated Sep. 5, 2014.
Office Action for corresponding application No. GB1515359.6, dated Apr. 21, 2016.
Search Report for corresponding Singapore application No. 11201603782X, dated Jul. 26, 2016.
Search Report for corresponding Singapore application No. 11201603785X, dated Jul. 26, 2016.

* cited by examiner

METHOD AND INSTALLATION FOR PRODUCING A PACK

CROSS REFERENCE TO RELATED APPLICATIONS

The present application is a 35 U.S.C. 371 National Application of PCT/EP2014/074398 filed Nov. 12, 2014, which claims priority to German Patent Application No. 10 2013 112 566.2, filed Nov. 14, 2013 the entire contents of which are incorporated entirely herein by reference.

The invention [relates to] a method and a system for producing a packaging out of a precut blank consisting of a foldable material such as corrugated cardboard, paperboard or carton. The precut blank can, for example have a bottom and hinged to it, two lateral panels, a rear panel and a front panel as well as, if applicable, two connecting flaps hinged to the front panel and two connecting flaps hinged to the rear panel for connecting the lateral panels with the front panel or the rear panel.

DE 10 2004 015 576 A1 proposes a precut blank [and] a regal tray produced from it with an elastic retraction means. The precut blank has a rectangular bottom, to the four edges of which lateral panels, a rear panel and a front panel are hinged respectively. At the rear panel, two connecting flaps are provided for connecting the rear panel with the lateral panels. Further, at the lateral panels, connecting flaps are provided for connecting the lateral panels with the front panel. Two ends of the elastic element are connected to the front panel in such a way that the ends point toward each other and a loop of the elastic element lies in the interior of the erected tray. Additional flaps are provided at the front panel that can be folded onto the front panel in such a way that the ends of the elastic element lie between the flaps and the front panel. After the erection of the tray out of the precut blank, the elastic element is fastened to the front panel and subsequently, the flaps are folded onto the front panel. After that, the elastic element is tensioned and products are filled into the tray so that the elastic element spans around these coming from the rear panel and along the lateral panels and pulls them in the direction toward the front panel. Hereby, an automatic advancing of the products within the tray is intended to be achieved.

Further, it is known to provide a slider or the like within a tray that is pulled toward the front panel of the tray by means of a closed elastic ring. U.S. Pat. No. 2,937,742 discloses such a slider that can be pulled within the tray in the direction toward the front panel from an elastic ring fastened at the front panel.

The as of yet unpublished international patent application PCT/GB2013/051755, describes the production of a packaging from a precut blank. Hereby, it is proposed that a strip consisting of an elastic material is attached to the precut blank or the packaging in such a way that it serves as product advancer for the products contained in the packaging. The fastening of the elastic strip is accomplished, for example, by gluing the unstressed strip onto the lateral panels of the partially erected packaging, whereby thereafter, the front panel of the packaging is erected and the connecting flaps are glued to the lateral panels over the fastening section of the strip. Alternatively, it is proposed to connect the elastic strip pre-tensioned with the two lateral panels and the flat precut prior to the erection of the packaging. The connection with the rear panel can, for example, be released upon opening the package. In the former alternative, the tensioning of the elastic strip takes place prior to the erection of the front panel and the connection of the connecting flaps of the front panel with the lateral panels by inserting a cassette through the opening area that is later to be closed by the front panel into the packaging, hereby displacing the elastic strip. In this condition the front panel can be closed and the packaging can be filled. Subsequently, the cassette is removed so that the elastic strip pushes the products toward the front panel within the packaging.

It is the objective of the present invention to propose a method and a system by means of which a packaging can be produced from a precut blank in a particularly efficient and reliable way.

This problem is solved by a method for producing a packaging, which includes the following steps: Providing a precut blank consisting of a foldable material that has a bottom and hinged to it two lateral panels, a rear panel and a front panel, subsequent fastening of a unstressed, elastic element to the front panel or to the connecting flaps hinged to the front panel, subsequent erection of the lateral panels, the rear panel and the front panel out of a flat transport condition into an unfolded usable condition and connecting the lateral panels with the rear panel and the front panel and subsequent tensioning of the elastic element.

The production of a packaging in this sequence has the advantage that the precut blank can be transported and stored in a flat transport condition. The elastic element can variably either be applied directly after producing the precut blank or only shortly before erecting the packaging out of the precut blank. In other words, the precut blank can be transported and stored with or without the elastic element. Furthermore, it is hereby also possible to equip an elastic element and thereby an advancing system for the packaging variably and individually. When the tensioning of the elastic element takes place only after the erection and connection of the walls, the packaging already has sufficient stability that helps to avoid any damage that could be caused by the elastic element during the tensioning process.

In the last step of the method, the elastic element is preferably tensioned in such a way that it extends on the inside of the packaging at least almost parallel to the lateral panels and the rear panel. This facilitates the filling of the erected packaging.

Preferably, the elastic element is locked in its tensioned condition after the tensioning process. Hereby it is possible to temporarily store the packaging that has been prepared for filling and/or transport it to a filling station.

The locking of the elastic element can be accomplished thereby, for example, that at the rear panel a detaining flap is hinged to the edge facing away from the bottom, whereby the elastic element is locked in its tensioned position, by fixing it between the rear panel and the detaining flap that is folded onto the rear panel after the tensioning of the elastic element. Hereby, it is preferred when a locking flap that is formed in the bottom by cuts or cutouts is unilaterally hinged to the bottom. Thereby, the detaining flap is locked in its position folded onto the rear panel, by deflecting the locking flap out of the plane of the bottom. The risk of damaging the elastic element can be minimized thereby, that fold-over flaps are hinged to the detaining flap at opposite edges that are folded unto the detaining flap and connected with it prior to tensioning the elastic element, in particular, prior to erecting the packaging.

The problem of the present invention is furthermore solved by a system for producing a packaging consisting of a flat precut blank that has a bottom and hinged to it two lateral panels, a rear panel and a front panel, as well as two connecting flaps hinged to the front panel and two connecting flaps hinged to the rear panel for connecting the lateral panels with the front panel and the rear panel. According to the invention, this system has at least one first station for erecting and connecting the lateral panels, the rear panel and the front panel, as well as a second station downstream of the first station for tensioning an elastic element that is fastened to the precut blank at two ends. In other words, the elastic element that is fastened to the packaging (or previously already to the precut blank) is tensioned out of an unstressed condition only then, when all walls of the packaging have been erected. The configuration of the stations in sequence has the effect that the elastic element is tensioned only then, when the packaging is already completely erected and the walls of the packaging are connected. This minimizes the risk of damaging packaging due to the tensile forces of the elastic element and during the tensioning process of the elastic element.

The first station for erecting the walls can, for example, have a die whose contour is adapted to the bottom. Furthermore, the die can have suction elements, for example, so that a precut blank can be fastened to the die. The die can then be guided through a suitably designed matrix with the precut blank, so that the panels are hereby deflected by about 90° relative to the bottom. Alternatively, it is also possible to deflect the walls individually relative to the bottom by means of corresponding manipulators.

The first station in which the walls are erected and connected can have a further station upstream for fastening two ends of an unstressed, strip-shaped, elastic element to the flat precut. This additional station upstream of the first station does not need to be at the same location as the first station. Rather, this upstream, additional station can be provided at the location of production of the precut blank so that the precut blank is delivered to the first station with the elastic element fastened on it already.

The second station in which the elastic element is tensioned preferably has at least two manipulators that are movable relative to the packaging erected in the first station. Preferably, these are respectively equipped to capture the elastic element away from its ends that are fastened to the precut blank and move along a track that has a directional component parallel to the lateral panels and a directional component parallel to the rear panel. For example, each manipulator can have a plate that is driven, guided in a guide plate, for example, an S-shaped slotted plate. Here, the term plate refers to a flat, two-dimensional element that can consist of metal or of another stiff or flexible material. The capturing of the elastic element by the manipulators thereby includes not only a tong-like grabbing of the elastic element from two sides, but also the case that a manipulator comes to abut the elastic element only from one side and displaces such. The movement of the elastic element in the two directional components can be a linear motion, for example, emanating approximately from a middle area of the front panel to the two corners between the rear panel and the lateral panels. Alternatively, the motion can extend along a bent and/or curved track. Hereby, it is particularly preferred when the manipulators are equipped in such a way that the elastic element is gripped at two off-center sections located at the front panel and pushed [into] the corners between the rear panel and the lateral panels. The point of contact by the manipulators at the elastic element is preferably dimensioned in such a way that the expansion of the elastic element is uniform without requiring a relative motion between the elastic element and the manipulators. This can be accomplished thereby, that the distance between the manipulators at the beginning of the tensioning process corresponds to the distance of the manipulators in the evenly tensioned condition.

It is particularly preferred when the second station has a first unit for folding a detaining flap of the precut blank onto the rear panel and the tensioned elastic element as well as the second unit for deflecting a locking flap of the precut blank relative to the bottom and the rear panel. Alternatively, the first unit and/or the second unit can also be provided in an additional station downstream of the second station.

The second station can have a fill station downstream for filling the erected packaging with products. Thereby, it is preferred when in the fill station a further unit for deflecting a locking flap of the precut blank relative to the bottom is provided that releases the locking of the detaining flap with the locking flap again. In other words, directly after filling the packaging, the elastic element is released in such a way that it first pushes the products toward the front panel via the detaining flap and after some products have been removed, it then slides off the detaining flap that then deflects in the direction toward the front panel and acts directly upon the products. Thereby, it is especially preferred when the deflecting of the locking flap for the release of the detaining flap is accomplished by the products themselves. The additional unit for deflecting the locking flap can thereby be the unit that inserts the products into the packaging.

The method and also the system according to the invention are based on a common idea that first, an unstressed elastic element is fastened to the precut blank. The, for example, band-shaped elastic element can, for example, be attached during the production of the precut blank already, or be attached to the precut blank subsequently in a further processing step upstream of filling. In this way, the precut can be equipped with an advancing system by attaching the elastic element in a particularly variable way. If the elastic element is attached to the flat precut in an unstressed condition, the precut and the elastic element can be transported and stored without an elastic element, just like conventional precut blanks. Thereby, that the elastic element is applied to the precut blank in its unstressed condition, no forces exerted by the elastic element that could lead to a deformation or even to damaging the precut can act upon the precut during transport and storage, i.e. prior to the erection of the precut into a packaging. Beyond that, any creeping of the elastic element or a loosening of the connection between the elastic element and the precut blank are largely precluded.

According to a preferred embodiment of the invention, the elastic element is a band consisting of a reversibly stretchable material that covers the front panel at least in sections. Suitable materials include, among others, rubber or latex. Preferably, the band has two free ends that are fastened to one of the connecting flaps respectively. Thereby, the free ends of the band point away from each other so that the elastic element can be placed on the connecting flaps and on the front panel as a linear strip.

To facilitate the removal of products out of the packaging producible from the precut blank, a removal opening can be formed in the front panel and/or in the bottom that preferably covers the elastic element at least in sections. The removal opening can be closed entirely or partially by a flap that can be ripped open and torn off.

The handling of the packaging to be produced from the precut can be facilitated thereby, that the elastic element can be locked in a tensioned condition. According to a preferred embodiment of the invention, a detaining flap is hinged to the rear panel at the edge facing away from the bottom for this purpose. Thereby, it is preferred when the width of the detaining flap that is delineated by free edges or groove or bending lines is smaller than the width of the bottom in the area between the lateral panels that are opposite to each other. In this way it is possible to fold the detaining flap onto the rear panel, even when a tool holds the elastic element in tensioned condition to the rear panel and, if applicable, abutting to the lateral panels. When the width of the detaining flap is only slightly smaller than the width of the bottom between the lateral panels, the elastic element extends nearly parallel to the lateral panels, which is preferred when products are being filled.

In order to not damage the elastic element in its tensioned condition by the cutting edges of the detaining flap, fold-over flaps are hinged to the detaining flap at opposite edges. These can be folded onto the detaining flap prior to the tensioning of the elastic element and, if applicable, connected with it so that the edges facing the lateral panels of the detaining flap are smooth and rounded.

The detaining flap can be held particularly easily in its position that tenses the elastic element when, by means of cuts or cutouts, a locking flap is built into the bottom of the precut blank that is hinged to the bottom unilaterally. This locking flap is preferably set back with its free edge facing the rear panel from the edge of the bottom to which the rear panel is hinged. Preferably, this free edge of the detaining flap is set back by at least one material thickness, in particular, at least twice the thickness of the material. When the locking flap is deflected slightly out of the plane of the bottom by means of the detaining flap after tensioning the elastic element and fastening the elastic element, the detaining flap is pushed against a free edge of the locking flap and fixated in its position folded onto the rear panel.

In order to prevent that the detaining flap and/or the locking flap are unintentionally deflected into a position in which the elastic element can relax due to the force of the elastic element, snap means can be provided on the detaining flap and/or the locking flap. This can be accomplished, for example, by snap protrusions at the locking flap and corresponding recesses at the detaining flap.

The invention also relates to a packaging that is unfolded by means of the method according to the invention and/or the system according to the invention from a precut blank of the type cited above that is automatically unfolded into an erected, usable condition from a flat transport condition. In this packaging, the elastic element is fastened between the connecting flaps hinged to the front panel and the lateral panels. In other words, in the erected packaging the elastic element extends parallel to the lateral panels in sections, as the connecting flaps at which the ends of the elastic element are preferably fastened, are folded onto the lateral panels. It is especially preferred when the two free ends of the elastic element are thereby clamped between the connecting flaps and the lateral panels, glued to the connecting flaps and the lateral panels. The middle section of the elastic element that is not firmly connected with the connecting flaps or the lateral panels extends in unstressed condition of the elastic element parallel to the front panel of the packaging. After the tensioning of the elastic element, this middle section of the element—not firmly connected with the packaging—preferably extends parallel to the lateral panels on the inner side of the packaging up to the rear panel and is fixed parallel to it on the inside by the detaining flap and/or the locking flap.

Additionally, the packaging can have a cover by means of which the area opposite to the bottom is closed after the packaging is filled. For this, the cover can have a surface opposite to the bottom and circumferential walls hinged to it that cover the lateral panels, the rear panel and/or the front panel at least in sections. The cover surface can additionally be provided with a tear strip that is delineated by a weakened line.

In the following, the invention will be described in further detail with the aid of exemplary embodiments and by referring to the drawing. Schematically shown are:

Figure 1:
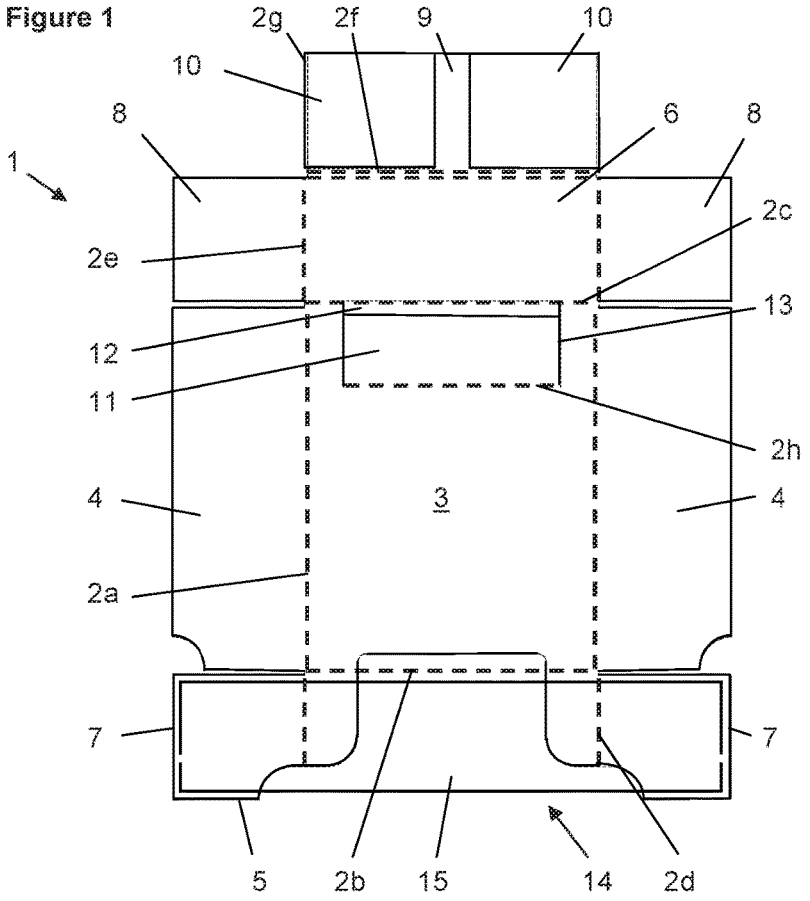
FIG. 1 shows a precut blank according to a first embodiment of the invention.

FIG. 1 shows a precut blank 1 in its flat transport condition. Precut blank 1 is provided with several groove or bending lines 2*a*, 2*b*, 2*c*, 2*d*, 2*e*, 2*f*, 2*g* by means of which a bottom 3, lateral panels 4, a front panel 5, a rear panel 6, connecting flaps 7 and 8, a detaining flap 9 and fold-over flaps 10 are defined.

As shown in FIG. 1, bottom 3 has a rectangular design in the embodiment shown in which groove or bending lines 2*a*, 2*b*, 2*c* that delineate bottom 3 extend perpendicular to each other. On the right and left side of bottom 3 in FIG. 1, the essentially rectangular lateral panels 4 are hingedly deflectable. Therefore, the lateral panels 4 are integrally connected with bottom 3. Front panel 5 is hinged to the lower side of bottom 3 in FIG. 1, the lateral edges of which are also defined by groove or bending lines 2*d* that hinge connecting flaps 7 to front panel 5. Even front panel 5 with connecting flaps 7 is thus integrally connected with bottom 3. On the upper side of bottom 3 in FIG. 1, the rear panel is hinged by a groove or bending line. The lateral edges of rear panel 6 are in turn defined by groove or bending lines 2*e* that hinge connecting flaps 8 to rear panel 6. On the upper side of rear panel 6 in FIG. 1, a double groove or bending line 2*f* hinges detaining flap 9, that is in turn connected with fold-over flaps 10 by lateral groove or bending lines 2*g*. Thereby, rear panel 6, connecting flaps 8, detaining flap 9 and fold-over flap 10 are likewise integrally connected with bottom 3.

In the embodiment shown in FIG. 1, groove or bending lines 2*d*, 2*e* that connect connecting flaps 7 and 8 with front panel 5 or rear panel 6 are located offset outward—opposite to groove or bending lines 2*a* that connect bottom 3 with lateral panels 4—by approximately one material thickness. This has the effect that when precut blank 1 is erected into a packaging, connecting flaps 7 can be fastened on the outside of lateral panels 4 without any warping of the packaging.

In bottom 3 of the embodiment shown, a locking flap 11 is formed by providing a recess 12 in the area of the groove or bending line 2*c* that connects bottom 3 with rear panel 6, and for such, cuts 13 that extend essentially rectangular are formed in bottom 3. By means of an additional groove or bending line 2*h*, locking flap 11 is connected deflectable with bottom 3.

In the embodiment shown, in front panel 5, a removal opening 14 is provided that extends slightly beyond groove and bending line 2*b* that connects bottom 3 with the front panel into the area of bottom 3. In the embodiment shown, removal opening 14 is provided in the middle of front panel 5 so that crosspieces of front panel 5 extend on both sides of removal opening 14.

Precut blank 1 according to the invention is provided with an elastic element 15 that is a strip or a band consisting of latex in the embodiment shown. Elastic band 15 has essentially the width of front panel 5, including connecting flaps 7, so that elastic band 15 can be placed onto connecting flaps 7 and front panel 5, whereby the free ends of elastic band 5 come to lie approximately near the free lateral edges of connecting flaps 7. In the embodiment shown, elastic band 15 is glued to the two connecting flaps 7 so that a middle section of elastic band 15 that covers the front panel of removal opening 14 in sections, lies loosely on precut blank 1 and is fastened only at the two ends.

Figure 2:
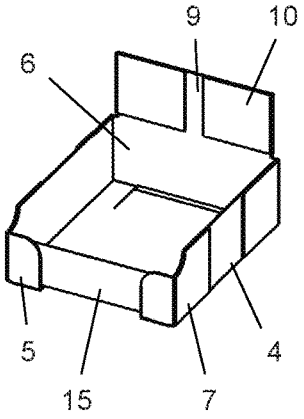
FIG. 2 shows a packaging erected from a precut blank according to FIG. 1 with an unstressed elastic element.

In the following, the erection of a packaging according to the invention from a precut blank according to FIG. 1 will be described in further detail. For this, first lateral panels 4 and front panel 5 and rear panel 6 are deflected by approximately 90° relative to bottom 3. Subsequently, connecting flaps 7 and 8 are likewise deflected by approximately 90° and fastened on the erected lateral panels 4 from the outside. Advantageously, this can be accomplished by adhesion. Alternatively, this can be accomplished by using clamps, for example. In this way, the lateral ends of elastic band 15 are clamped between connecting flap 7 and the outside of lateral panels 4 and connected with the respective connecting flap 7 as well as also the respective lateral panel 4. Thus, elastic band 15 extends in sections along the erected lateral panels 4 and lies inside parallel to front panel 5 without, however, being firmly connected to it. This condition is shown in FIG. 2.

Figure 3:
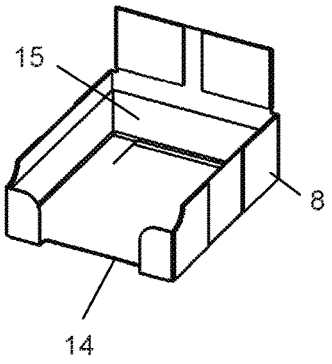
FIG. 3 shows the packaging according to FIG. 2 with a tensioned elastic element.

Now, elastic band 15 can be tensioned. Hereby, it is advantageous if the packaging has already been erected completely and the lateral panels are connected with front panel 5 and rear panel 6 so that the packaging has sufficient stability. As will be explained in further detail below, the elastic band is tensioned in such a way that it extends, as shown in FIG. 3, lying on the inside approximately parallel to the lateral panels and parallel to rear panel 6. In this condition, detaining flap 9 can be deflected inward by 180° so that it clamps elastic band 15 between itself and rear panel 6. Previously, fold-over flaps 10 have been folded onto detaining flap 9 so that fold-over flaps 10 abut at elastic band 15.

In this position, detaining flap 9 can be locked against the tension of elastic band 15 by slightly deflecting locking flap 11 upward out of the plane of bottom 3. Hereby, the free edge of locking flap 11 that is facing rear panel 6 pushes at almost a right angle against the lower side of detaining flap 9 in FIG. 4 and thus prevents that detaining flap 9 is deflected forward or upward by the reset force of elastic band 15—in FIG. 4.

Figure 4:
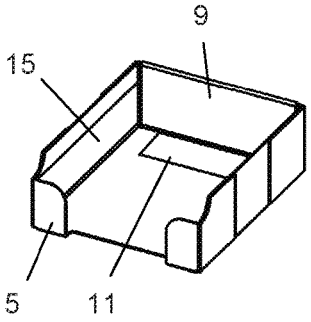
FIG. 4 shows the packaging according to FIG. 2 with a tensioned and locked elastic element.

In the condition of the packaging shown in FIG. 4, it can be filled. As the result of filling the packaging, the products exert pressure onto locking flap 11, so that it is pushed back into its initial position in which it extends in a plane with bottom 3. Thus, by means of the filling process, the lock of detaining flap 9 by locking flap 11 is released again. Elastic band 15 thus pushes the products contained in the packaging toward the front panel and removal opening 14 via detaining flap 9.

If individual products are now removed through the removal opening or removed upward, elastic band 15 first pushes the products remaining in the packaging further toward front panel 5 via detaining flap 9. After a few products have been removed from the packaging, detaining flap 9 is deflected to such a degree by the reset force of elastic band 15 that it extends approximately parallel to the bottom, for example. Shortly before reaching this condition already, elastic band 15 slides off detaining flap 9 and exerts a tensile force toward front panel 5 directly upon the products remaining in the packaging. Thus elastic band 15 surrounds the products remaining in the packaging laterally and from the rear. This prevents that products, for example bar-like products fall over in the packaging and are thereby not as easily identifiable or removable by the consumer through removal opening 14.

FIG. 2 through 4 shows a packaging erected from precut blank 1 in the form of an open tray (chute). After filling, the tray can be closed with a cover that has a cover surface opposite to bottom 3 and circumferential walls hinged to it. The circumferential walls can, for example, abut on the outside on the lateral panels 4 and the rear panel 6. A further circumferential wall can be inserted into the packaging so that it abuts inside at the front panel and thus closes the removal opening 14. Alternatively, it is also possible to locate this additional circumferential wall on the outside on the front panel. Preferably, at least one area of the cover surface and/or the front panel associated with the circumferential wall of the cover is designed to be ripped open or torn off, so that the packaging that is provided with a covering can be opened easily.

In the following, the process of tensioning elastic band 15 and the locking of elastic band 15 by means of detaining flap 9 and locking flap 11 will be described in further detail by referring to FIG. 5 through 8. These Figures show a station into which the erected packaging as shown in FIG. 2 is inserted and converted into the condition shown in FIG. 4.

Figure 5:
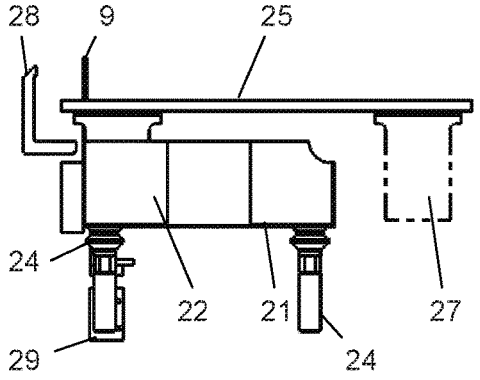
FIG. 5 shows a station for tensioning the elastic element in a lateral view.
Figure 6:
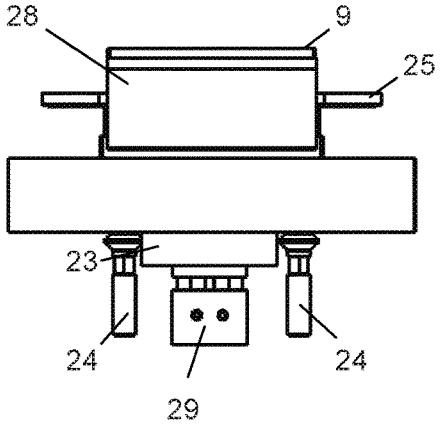
FIG. 6 shows a front view of the station according to FIG. 5.

For this, as shown in FIG. 5, station 20 has an adapter for the packaging. The adapter is formed by a bottom 21, lateral walls 22 and a rear wall 23. The adapter is thus open on the right side in FIG. 5, so that the packaging can be inserted into the adapter. In the embodiment shown, four openings are provided in bottom 21 by means of which suction elements 24 can retain bottom 3 of the packaging within the adapter.

Figure 7:
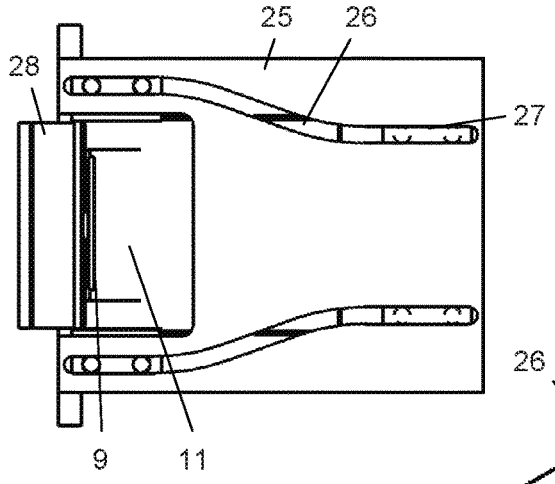
FIG. 7 shows a top view of the station according to FIG. 5.

A plate 25 is mounted above the adapter in which two guide plates 26 are provided. Guide plates 26 are formed as an approximately S-shaped opening or slot in the embodiment shown, in which respectively one plate 27 is guided displaceable. Plates 27 can be displaced by a drive—not shown in further detail—from the position on the right shown in FIG. 5 as dotted line—into the position on the left shown with solid lines. In FIG. 7, the two bearings of plates 27 are also shown by two dotted lines respectively, and/or two solid circles in the different positions of the plates.

Guide plates 26 in plate 25 are designed in such a way that plates 27 can enter through removal opening 14 in front panel 5 into the packaging. Hereby, when the packaging is inserted into the station, the elastic band 15 can come to abut with the left edge of the respective plates 27 (although this abutment is not shown in FIG. 5). Plates 27 thus serve as manipulators that push the elastic band 15 into the corners of lateral panels 4 with rear panel 6 by moving plates 27 along guide plate 26 to the left in FIG. 5. In this way, elastic band 15 is tensioned. Plates 27 are preferably comparatively thin so that plates 27 abut as tightly as possible to lateral panels 4 in their position on the left in FIG. 5, without impeding the folding over of detaining flap 9.

Figure 8:
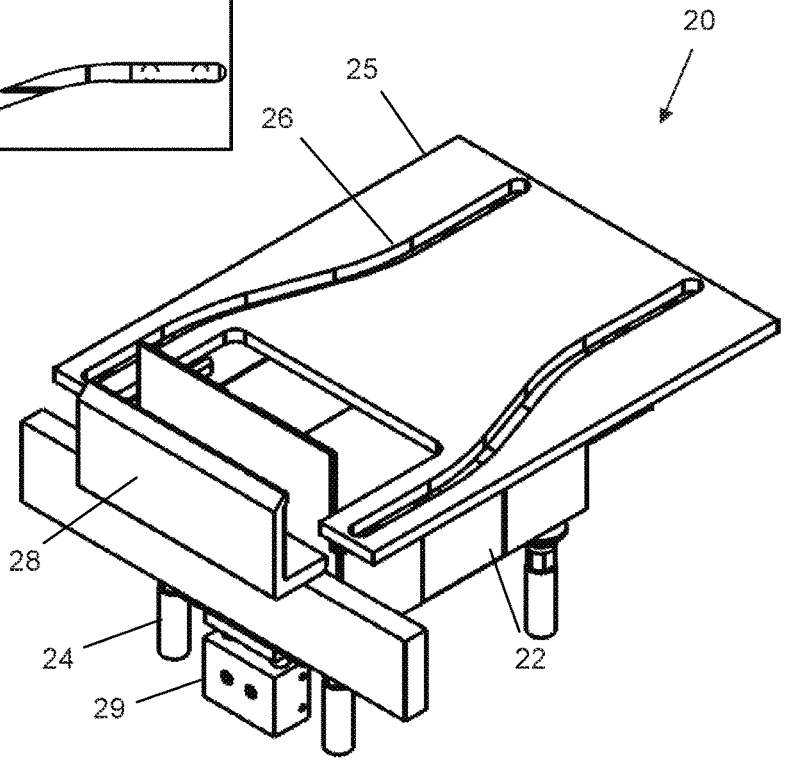
FIG. 8 shows a perspective view of the station according to FIG. 5.

For this, an angle 28 is provided in station 20 that has a width as shown in FIG. 8 corresponding approximately to that of detaining flap 9. Angle 28 can be deflected clockwise from its position shown in FIG. 5 by means of a drive that is not shown in further detail, so that the longer perpendicular leg of angle 28 in FIG. 5 contacts detaining flap 9 and folds it onto rear panel 6.

In other words, angle 28 in operation brings detaining flap 9 out of the position shown in FIG. 3 into the position shown in FIG. 4.

Further, a cylinder unit 29 is provided in station 20, whose plunger can act upon locking flap 11 of the packaging through an additional opening in bottom 21. After the folding over of detaining flap 9, cylinder unit 29 is actuated and thereby slightly deflecting locking flap 11 out of its position lying in the plane of bottom 3 into the interior of the packaging so that the free edge of locking flap 11 comes in contact with the lower side of detaining flap 9. This prevents that detaining flap 9 is deflected back due to the force of elastic band 15 when angle 28 returns into its initial position—shown in FIG. 5—and plates 27 are moved back again into the position on the right in FIG. 5. The packaging is thus in a condition according to FIG. 4 in which the packaging can be filled.

Deviating from the embodiment of precut blank 1 and station 20 described above, it is alternatively also possible to dispense with detaining flap 9, fold-over flaps 10 and/or locking flap 11. In this case, elastic band 15 is tensioned by plates 27 as described above and the packaging must then be filled while plates 27 hold elastic band 15 tensioned. Thereby, elastic band 15 acts directly upon the products after filling as soon as plates 27 are disengaged from band 15.

Station 20 can have a further station upstream—not shown in the Figures—in which the packaging is erected from precut blank 1 and glued. For example, this upstream station can be designed as described in the as of yet unpublished, international patent application PCT/GB2013/051755.

Elastic band 15 can be applied to precut blank 1 in a unit upstream of station 20. For example, this can be accomplished thereby that from a roll that has a width corresponding approximately to the distance of the free lateral edges of connecting flaps 7, elastic band is uncoiled and applied to a substrate. This substrate is preferably connected with a suction unit so that the uncoiled material is retained on the substrate. On this substrate, the uncoiled material can then be cut into strips that have a suitable height for advancing the products in the packaging. This custom-cut strip can then be fed to precut blank 1 and glued together with it to connecting strip 7.

Figure 9:
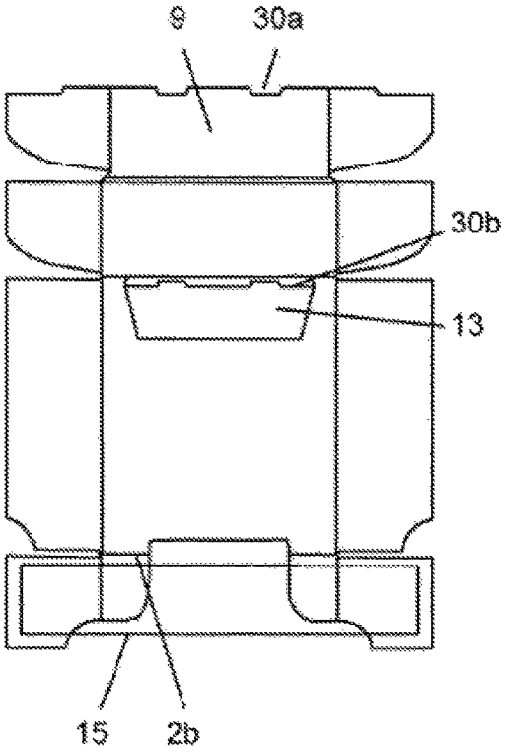
FIG. 9 shows a precut blank according to a second embodiment of the invention.
Figure 10:
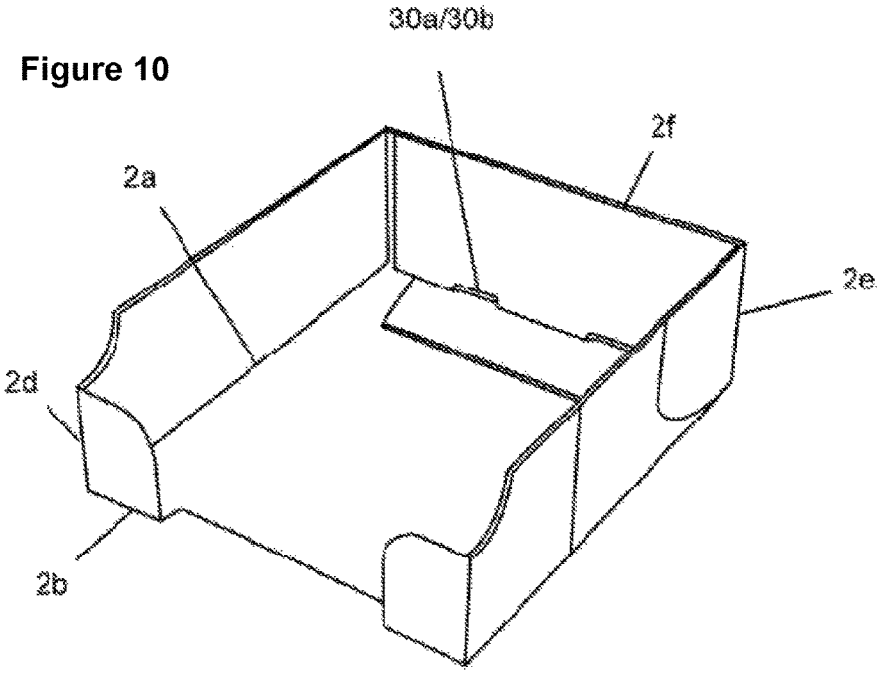
FIG. 10 shows an erected packaging from the precut blank according to FIG. 9.

FIGS. 9 and 10 shows a second embodiment that has a fundamentally similar structure to the first embodiment. On the upper side of detaining flap 9 in FIG. 9, however, cutouts 30*a* are provided. Corresponding cutouts 30*b* are also provided at the free edge of locking flap 11 that faces rear panel 6. As in FIG. 10—in which elastic band 15 was omitted for reasons of clarity—shows, these cut-outs 30*a*, 30*b* have the effect of a serration that prevents—in erected condition of locking flap 11—that it can be pushed out of the position that locks detaining flap 9 due to the force of elastic band 15. In other words, locking flap 11 and detaining flap 9 snap into each other to secure elastic element 15 via detaining flap 9.

Figure 11:
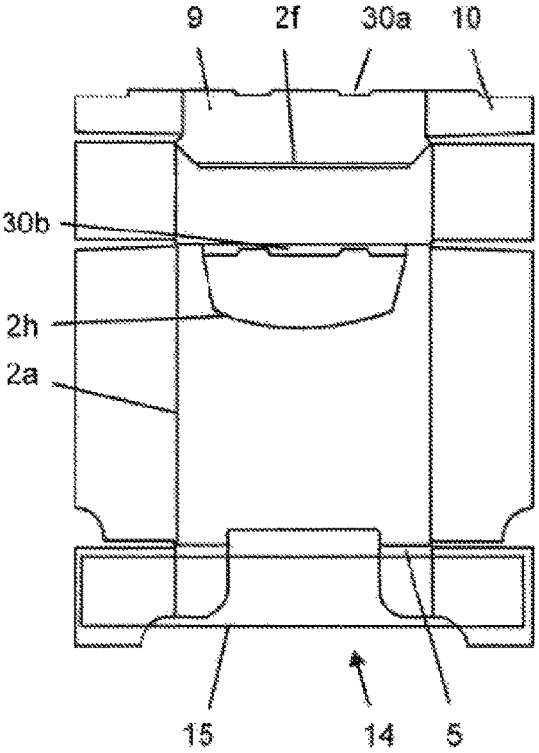
FIG. 11 shows a precut blank according to a third embodiment of the invention.

A modification of this embodiment is shown in FIG. 11. Hereby, first of all, the groove or bending line 2*h*, by means of which locking flap 11 is connected with bottom 3, has a curved design. This increases the reset force. Additionally, cuts 13 are slanted. Regardless of that, rear panel 6 has a shorter design than in the other embodiments. Correspondingly, the height of the fold-over flaps 10 is also shorter. To avoid a sharp edge with connecting flap 8, the double groove of bending line 2*f* therefore does not extend over the entire width of rear panel 6 and—starting from the ends of the double groove or bending line 2*f*—slanted cuts extend to the respective corners of connecting flaps 8.

REFERENCE NUMBERS

1 Precut
2*a-h* Groove or bending line
3 Bottom
4 Lateral wall
5 Front panel
6 Rear panel
7 Connecting flap
8 Connecting flap
9 Detaining flap
10 Fold-over flap
11 Locking flap
12 Recess
13 Cut
14 Removal opening
15 Elastic element (band)
20 Station
21 Bottom
22 Lateral wall
23 Rear wall
24 Suction element
25 Plate
26 Guide plate
27 Plate (manipulator)
28 Angle
29 Cylinder
30*a, b* Cutout

What is claimed is:

1. A method for producing a packaging, the method comprising:

a) providing a precut blank consisting of a foldable material that has a bottom and, hinged to the bottom, two lateral panels, a rear panel, and a front panel, b) subsequently fastening an unstressed elastic element having two free ends pointing away from each other to connecting flaps that are hinged to the front panel, c) subsequently erecting the lateral panels, the rear panel and the front panel out of a flat transport condition into an unfolded usable condition and connecting the lateral panels with the rear panel and the front panel, d) subsequently tensioning the elastic element.

2. The method as recited in claim 1, wherein the elastic element in step d) has a tensioned condition such that the elastic element extends on an inside of the packaging parallel to the lateral panels and the rear panel.

3. The method as recited in claim 1, wherein the elastic element is locked in tensioned condition after step d).

4. The method as recited in claim 3, wherein a detaining flap is hinged to the rear panel, whereby the elastic element is locked in the tensioned condition by being fixed between the rear panel and the detaining flap that is folded unto the rear panel after the elastic element has been tensioned.

5. The method as recited in claim 4, a locking flap is formed in the bottom by cuts or cutouts and is hinged unilaterally to the bottom, whereby the detaining flap is locked in a position folded onto the rear panel by deflecting the locking flap out of a plane of the bottom.

6. The method as recited in claim 4, wherein fold-over flaps are hinged to the detaining flap at opposite edges, whereby the fold-over flaps are folded onto the detaining flap and connected with such prior to step d), in particular prior to step c).

7. A system for producing a packaging, in particular a tray, out of a flat precut blank that has a bottom and, hinged to the bottom, two lateral panels, a rear panel, and a front panel, wherein a first two connecting flaps are hinged to the front panel and a second two connecting flaps are hinged to the rear panel for connecting the lateral panels with the front panel and the rear panel, the precut blank further comprising an elastic element fastened to the first two connecting flaps of the precut blank at two ends, the system comprising:

a first station for erecting and connecting the lateral panels, the rear panel and the front panel, and a second station downstream of the first station for tensioning the elastic element.

8. The system as recited in claim 7, wherein the first station has an additional station for fastening two ends of an unstressed, strip-shaped elastic element on the flat precut blank.

9. The system as recited in claim 7, wherein the second station has at least two manipulators movable relative to the packaging erected in the first station, that are respectively equipped to capture the elastic element away from the two ends that are fastened to the first two connecting flaps of the precut blank and move the elastic element along a track that has a directional component parallel to the lateral panels and a directional component parallel to the rear panel.

10. The system as recited in claim 9, wherein each manipulator has a plate that is driven and movable guided by a guide plate.

11. The system as recited in claim 7, wherein the second station or an additional station downstream of the second station has a first unit for folding a detaining flap of the precut blank onto the rear panel and the tensioned elastic element and a second unit for deflecting a locking flap of the precut blank relative to the bottom.

12. The system as recited in claim 7, wherein the second station has a filling station for filling the erected packaging with products, wherein in the filling station a further unit is provided for deflecting a locking flap of the precut blank relative to bottom.

* * * * *